US009157718B2

(12) United States Patent
Ross

(10) Patent No.: US 9,157,718 B2
(45) Date of Patent: Oct. 13, 2015

(54) INTERRUPTOR SUB, PERFORATING GUN HAVING THE SAME, AND METHOD OF BLOCKING BALLISTIC TRANSFER

(75) Inventor: Colby Ross, Hockley, TX (US)

(73) Assignee: Baker Hughes Incorporated, Houston, TX (US)

( * ) Notice: Subject to any disclaimer, the term of this patent is extended or adjusted under 35 U.S.C. 154(b) by 866 days.

(21) Appl. No.: 13/367,992

(22) Filed: Feb. 7, 2012

(65) Prior Publication Data

US 2013/0199843 A1 Aug. 8, 2013

(51) Int. Cl.

| | |
|---|---|
| ***E21B 43/116*** | (2006.01) |
| ***F42C 15/188*** | (2006.01) |
| ***E21B 43/1185*** | (2006.01) |
| ***F42C 15/42*** | (2006.01) |

(52) U.S. Cl.

CPC ..... *F42C 15/188* (2013.01); *E21B 43/1185* (2013.01); *F42C 15/42* (2013.01)

(58) Field of Classification Search

USPC ..... 89/1.15; 102/226, 229, 256, 222, 223, 102/225, 254

See application file for complete search history.

(56) References Cited

U.S. PATENT DOCUMENTS

| | | | | |
|---|---|---|---|---|
| 4,523,650 | A * | 6/1985 | Sehnert et al. | 175/4.56 |
| 5,115,865 | A | 5/1992 | Carisella et al. | |
| 5,223,665 | A | 6/1993 | Burleson et al. | |
| 5,346,014 | A | 9/1994 | Ross | |
| 5,680,905 | A | 10/1997 | Green et al. | |
| 5,908,365 | A | 6/1999 | LaJaunie et al. | |
| 6,779,605 | B2 * | 8/2004 | Jackson | 166/297 |
| 7,487,833 | B2 | 2/2009 | Grigar et al. | |
| 7,770,662 | B2 | 8/2010 | Harvey et al. | |
| 8,056,632 | B2 | 11/2011 | Goodman | |
| 8,113,119 | B2 * | 2/2012 | Crawford | 102/313 |
| 8,424,455 | B2 * | 4/2013 | Crawford, II | 102/229 |
| 2002/0185276 | A1 * | 12/2002 | Muller et al. | 166/297 |
| 2007/0267195 | A1 * | 11/2007 | Grigar et al. | 166/297 |
| 2008/0134922 | A1 * | 6/2008 | Grattan et al. | 102/206 |
| 2010/0005992 | A1 * | 1/2010 | Crawford | 102/202.1 |

OTHER PUBLICATIONS

International Search Report and Written Opinion, date of mailing May 15, 2013, International appln No. PCT/US2013/024816, Korean Intellectual Property Office, International Search Report 5 pages, Written Opinion 6 pages.

(Continued)

*Primary Examiner* — William P Neuder
*Assistant Examiner* — Ronald Runyan
(74) *Attorney, Agent, or Firm* — Cantor Colburn LLP

(57) ABSTRACT

An interruption sub for a downhole tool the downhole tool activatable by detonation. The interruption sub includes a barrier movable between a biased closed position and an open position. Preventing ballistic transfer to the downhole tool in the closed position and allowing ballistic transfer to the downhole tool in the open position. A detonation path within the interruption sub, wherein the barrier is hydraulically or electronically movable from the closed position to the open position in response to at least one condition acceptable for ballistic transfer. Also included is a downhole tool activatable by detonation.

22 Claims, 8 Drawing Sheets

(56) References Cited

OTHER PUBLICATIONS

Omar Mohamed and Stan Davis, Integrating Lessons Learned from over 20 Years of One-trip Tubing-conveyed Perforating and Frac Pack/gravel Pack Applications, paper was prepared for presentation at the 2010 Offshore Technology Conference, Houston, Texas, USA, May 3-6, 2010, OTC 20883, Offshore Technology Conference, pp. 1-5.

J.V. Carisella, R.B. Cook and J.E. Beardmore Jr., "Three New Systems That Prevent Firing of Perforating Guns and String Shots on or Near the Surface" paper was prepare for presentation at the 66th Annual Technical Conference and Exhibition of the Society of Petroleum Engineers, Dallas, TX, Oct. 6-9, 1991. SPE 22556, Society of Petroleum Engineers Inc., pp. 213-228.

* cited by examiner

INTERRUPTOR SUB, PERFORATING GUN HAVING THE SAME, AND METHOD OF BLOCKING BALLISTIC TRANSFER

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Thereafter, a series of casing strings may be set in the borehole and cemented into place. Communication between the casing string annulus and subterranean reservoirs containing natural resources is necessary for any of the above noted activities.

Perforating is the process of piercing the casing wall and cement to provide openings through which formation fluids and gas may enter. Since the charges employed in perforating are very powerful, extreme care must be employed to assure no detonation can occur at the surface and that detonation can only occur below the surface. Also, it is desired that the gun fire at the proper depth, since early detonation will result in holes in the casing at undesirable depths. Further, if the guns do not fire for whatever reason such as mechanical problems and it becomes necessary to pullout out of the wellbore with the loaded guns, additional burdensome procedures are required as well as the added expense.

Prior art systems for preventing premature detonation of the downhole tools includes plugs which remain solid at surface temperature, but which melt at downhole temperatures, such as disclosed in U.S. Pat. No. 5,115,865 to Carisella et al. and U.S. Pat. No. 5,223,665 to Burleson et al. U.S. Pat. No. 5,346,014 incorporates a rotating plug, which is actuated by a thermally responsive torsion member.

As can be appreciated, premature actuation of the downhole tools, whether on surface or downhole, must be avoided. The art would be receptive to alternative devices and methods for blocking inadvertent ballistic transfer.

BRIEF DESCRIPTION

An interruption sub for a downhole tool, the downhole tool activatable by detonation, the interruption sub includes a barrier movable between a biased closed position and an open position, and preventing ballistic transfer to the downhole tool in the closed position and allowing ballistic transfer to the downhole tool in the open position; and, a detonation path within the interruption sub; wherein the barrier is hydraulically or electronically movable from the closed position to the open position in response to at least one condition acceptable for ballistic transfer.

A downhole tool activatable by detonation, the downhole tool includes a barrier movable between a biased closed position and an open position, and preventing ballistic transfer in the closed position and allowing ballistic transfer in the open position; an explosive member; and, a detonation member separated from the explosive member by the rotatable barrier in the closed position; wherein the barrier is hydraulically or electronically movable from the closed position to the open position in response to at least one condition acceptable for ballistic transfer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
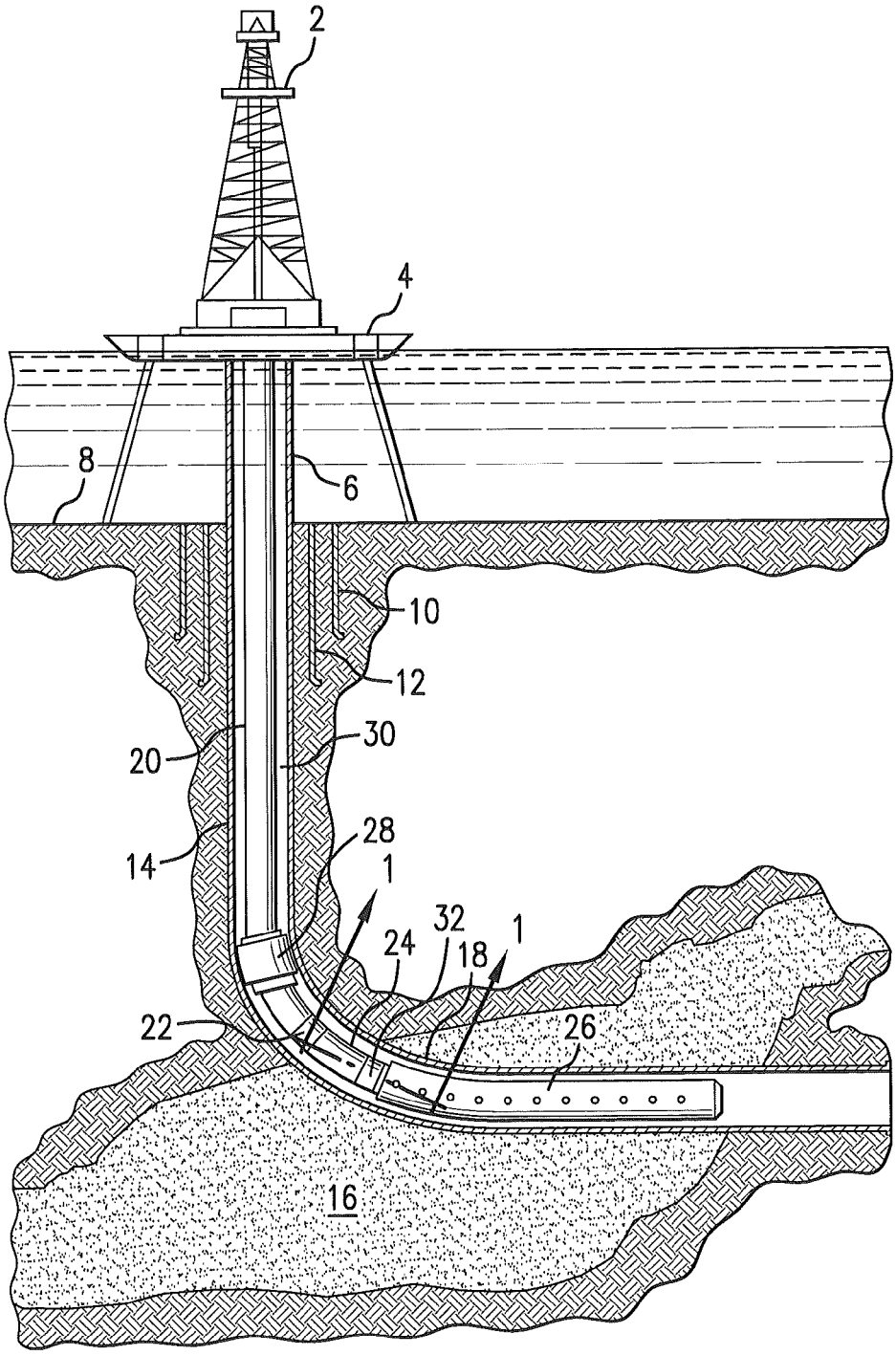
FIG. 1 depicts a cross-sectional view of a semi-submersible drilling rig with a borehole extending therefrom.

Referring to FIG. 1, a drilling rig 2 positioned on a semi-submersible drilling platform 4 is shown. Extending from the platform 4 is a riser 6 that runs to the sea floor 8. A series of casing strings 10, 12, 14, penetrate the subterranean reservoirs that have been drilled through by a bit means (not shown). After the drilling phase, the casing strings 10, 12, 14 are cemented into place.

The production casing string 14 will penetrate a reservoir 16 that will contain hydrocarbons. In order to produce the hydrocarbons, it is necessary to communicate the wellbore annulus 18 with reservoir 16 by perforating the casing string 14 and the cement that directly surrounds the casing 14.

A work string 20, which could be a drill pipe, production tubing, coiled tubing or wire line, is lowered into the wellbore, through which the casing string 14 extends. The work string 20 will have attached thereto a bottom hole assembly 22, with the bottom hole assembly including the firing head apparatus 24 and operatively connected thereto the perforating gun 26 containing a series of shaped charges, and typically including a housing, an initiator, and a quantity of high explosive. A detonating cord is attached to each shaped charge to sequentially actuate the initiator within each shaped charge. To detonate the perforating guns 26, a metal bar could be dropped from the surface, which ultimately strikes a mechanical piston, which in turn initiates the detonation. Alternatively, hydraulic means have been employed that utilize a hydraulic piston responsive to pressure in order to initiate detonation. The work string 20 may also have a packer 28 for sealingly engaging the walls of the casing string 14 so that the lower annulus 18 and upper annulus 30 is formed.

According to the exemplary embodiments disclosed herein, an interruption sub 32 is interposed between the firing head apparatus 24 and the perforating gun 26.

Figure 2:
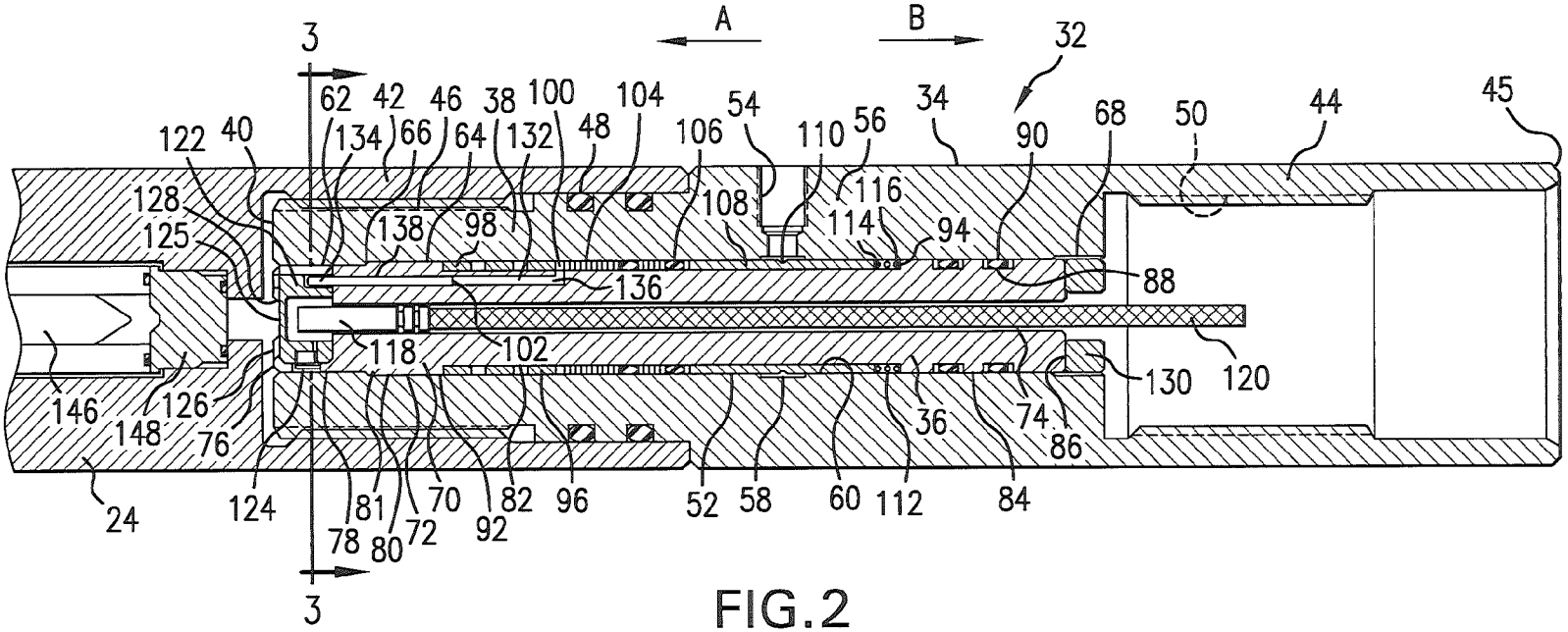
FIG. 2 depicts a sectional view, taken along a portion of line 1-1 of FIG. 1, of an exemplary embodiment of an interruption sub of FIG. 1 with a barrier in a closed position.

Referring to FIG. 2, an exemplary embodiment of an interruption sub 32 is shown. The interruption sub 32 includes a first housing 34 and a cartridge 36 installed within the first housing 34. The first housing 34 is connectable to and interposed between firing head apparatus 24 and perforating gun 26 (FIG. 1). The firing head apparatus 24 includes firing head or pin 146 and explosive member 148. Details of an exemplary perforating gun 26, usable as the downhole tool connected to the interruption sub 32, are described in U.S. Pat. No. 5,680,905 to Green et al., which is herein incorporated by reference. Alternatively, the first housing 34 may be connectable between any sort of gun or booster on one end, and any sort of downhole tool that uses explosives and other pyrotechnic materials for initiation, such as, but not limited to the above-described perforating gun 26, squibs usable for releasing mechanically biased members, tubing cutters for cutting borehole tubular members, and back-off shots for providing shock to loosen threaded pipe joints within boreholes, or downhole tools which apply non-explosive forces such as a wireline pressure setting assembly, usable for setting bridge plugs and packers within boreholes. For the purposes of this description, the interruption sub 32 will be described as disposed between the firing head apparatus 24 and the perforating gun 26.

The first housing 34 of the interruption sub 32 includes a first fitting 38 at a first end 40 thereof, the first end 40 corresponding to an uphole end and a first end of the interruption sub 32, suitable for attachment with a housing 42 of the firing head apparatus 24, and a second fitting 44 at a second end 45 thereof, a downhole end, suitable for attachment with a housing of the perforation gun 26. In the illustrated embodiment, external threads 46 and seals 48 such as O-rings are provided for the first fitting 38 and internal threads 50 are provided at the second fitting 44, although these may be reversed or a different combination of styles of fittings such as, but not limited to, threads, shoulders, grooves, seals, etc. may be employed. The first housing 34 further includes a longitudinal bore 52 sized to accommodate the cartridge 36 therein. A lateral aperture 54 is provided through a wall 56 of the first housing 34 to the longitudinal bore 52. A grooved ring 58 is provided within an interior surface 60 of the wall 56. The grooved ring 58 surrounds the cartridge 36, is in communication with the longitudinal bore 52, and is aligned and in communication with the lateral aperture 54. The first end 40 of the first housing 34 includes a first inner portion 62 adjacent a second inner portion 64 with a ledge 66 therebetween. Uphole of the second fitting 44, an interior threaded portion 68 may be provided therein.

The cartridge 36 of the interrupter sub 32 includes second housing 70 having an outer surface 72 and an inner longitudinal bore 74 providing a detonation pathway. A first end 76, or uphole end, of the second housing 70 includes a first outer portion 78 and an adjacent second outer portion 80 with a shoulder 81 therebetween that abuts with the ledge 66 of the first housing 34 when the cartridge 36 is installed, with the first outer portion 78 of the second housing 70 within the first inner portion 62 of the first housing 34. The second housing 70 further includes a third outer portion 82 indented from the second outer portion 80, and a fourth outer portion 84 towards a second end 86, or downhole end, of the second housing 70 having grooves 88 for accepting seals 90 such as O-rings therein. A first boundary wall 92 of the third outer portion 82 divides the third outer portion 82 from the second outer portion 80, and a second boundary wall 94 of the third outer portion 82 divides the third outer portion 82 from the fourth outer portion 84. A first spring 96, such as the illustrated square wire spring, surrounds the outer surface 72 of the second housing 70 in the third outer portion 82. A first end 98, or uphole end, of the first spring 96 abuts with the first boundary wall 92. Adjacent, or downhole of, the first spring 96, a ring portion 100 of a control arm 102 surrounds the third outer portion 82. Adjacent, or downhole of, the ring portion 100, a plurality of spacers 104, such as backup split rings, surround the third outer portion 82 so that the ring portion 100 is interposed between the first spring 96 and the spacers 104. One or more seals 106, such as O-rings, further surround the third outer portion 82 amongst the spacers 104. Adjacent, or downhole of, the seals 106, a follower sleeve 108 surrounds the third outer portion 82. A visual indicator marking 110, such as a line, may be scored, painted, or otherwise disposed on an exterior surface of the follower sleeve 108. A compression spring 112 is disposed around the third outer portion 82 adjacent, or downhole of, the follower sleeve 108, with a first end 114, or uphole end, of the compression spring 112 adjacent the follower sleeve 108. A second end 116, or downhole end, of the compression spring 112 abuts with the second boundary wall 94 of the third outer portion 82. Thus, the first spring 96, ring portion 100 of the control arm 102, spacers 104 and seals 106, follower sleeve 108, and compression spring 112 surround the third outer portion 82 between the first boundary wall 92 and the second boundary wall 94. The bias of the compression spring 112 in the direction A, or uphole direction, is insufficient to overcome the bias of the first spring 96 in direction B, opposite direction A, or downhole direction, so that while the first spring 96 remains substantially uncompressed in the inactivated state of the interruption sub 32 (where ballistic transfer is prevented between the firing head apparatus 24 and the perforating gun 26), the compression spring 112 remains substantially compressed in the inactivated state. A spacing between rings of the first spring 96 may be greater than a spacing between rings of the compression spring 112.

Figure 3:
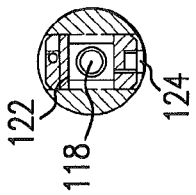
FIG. 3 depicts a cross-sectional view, taken along a portion of line 3-3 of FIG. 2, of an exemplary first end of a cartridge of the interruption sub of FIG. 2, with the barrier in the closed position.
Figure 4:
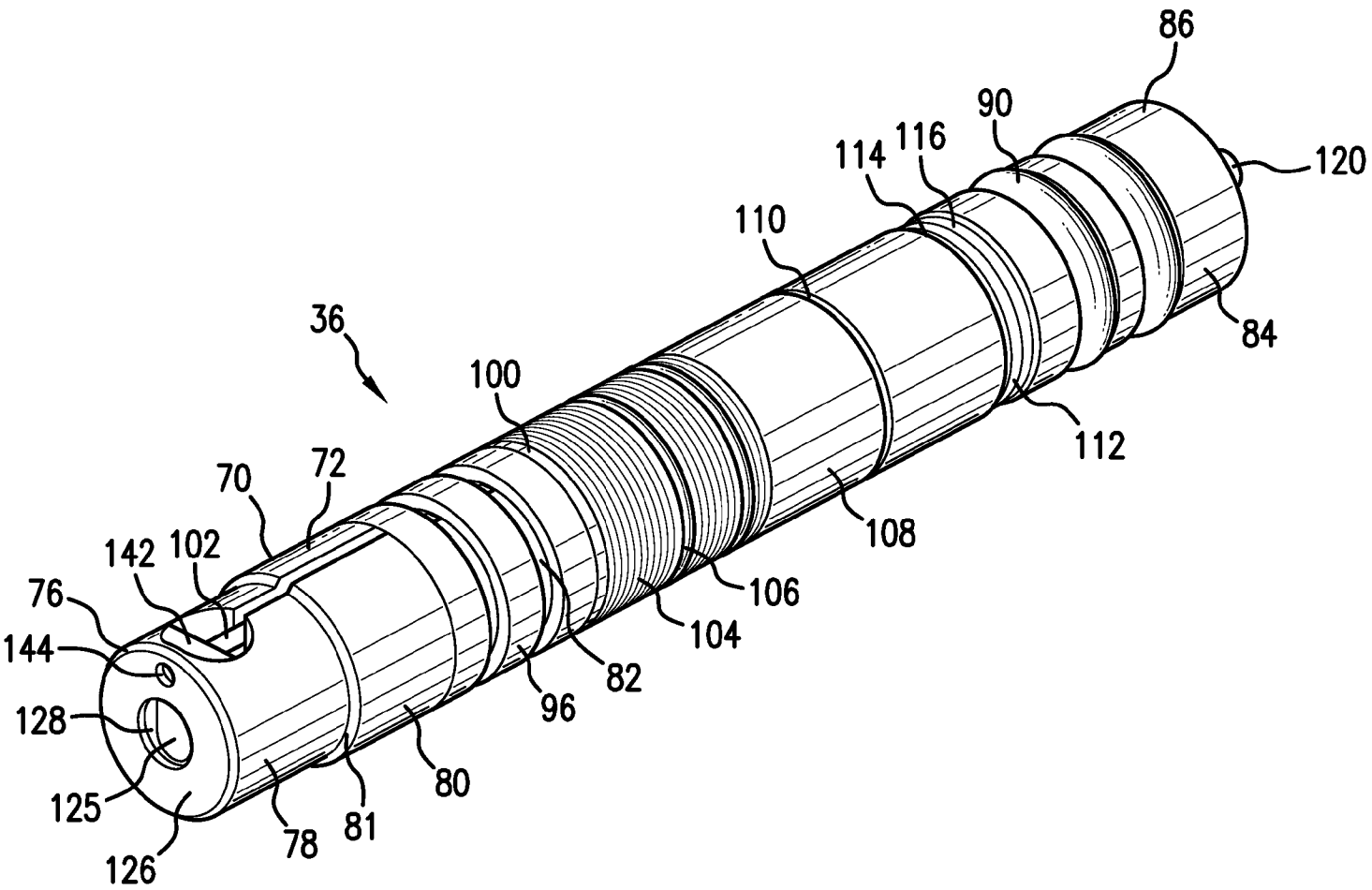
FIG. 4 depicts a perspective view of the cartridge for the interruption sub of FIG. 2 with the barrier in the closed position.
Figure 5:
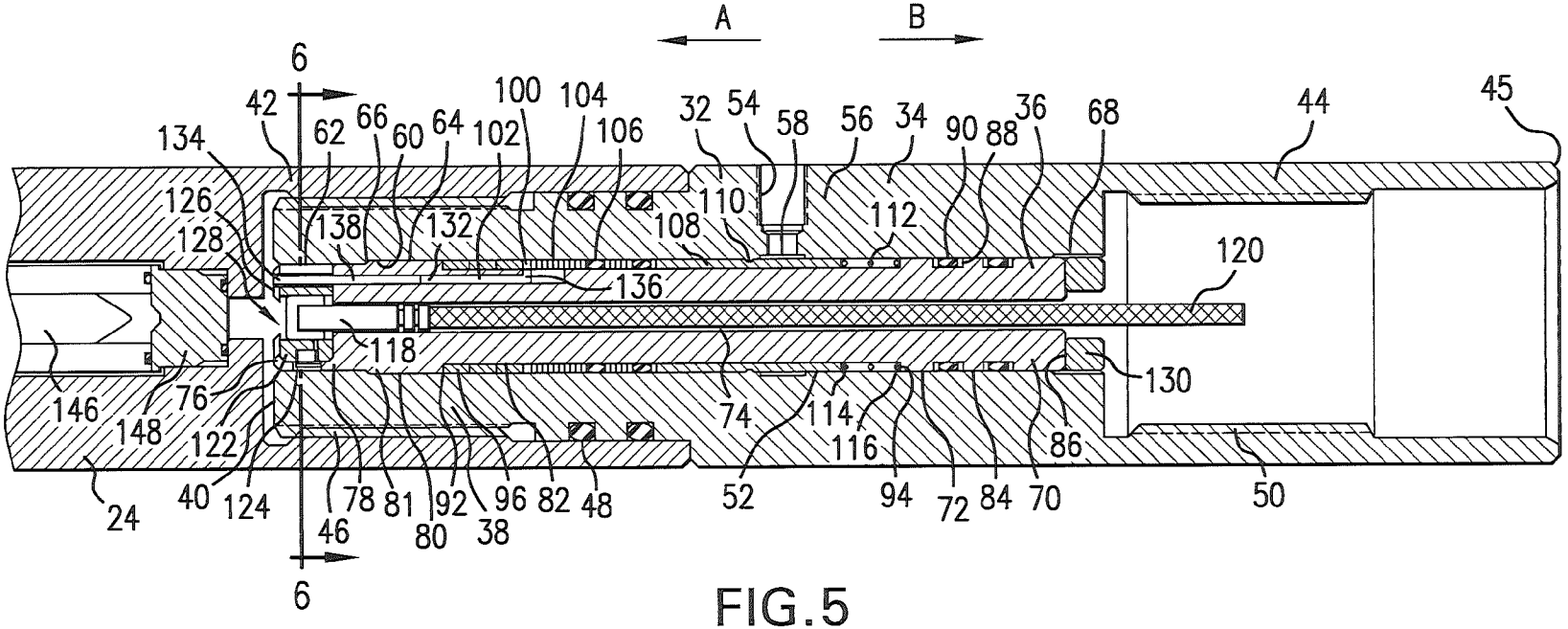
FIG. 5 depicts a sectional view, taken along a portion of line 1-1 of FIG. 1, of the interruption sub of FIG. 2 with the barrier in an open position.
Figure 6:
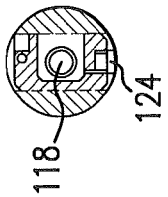
FIG. 6 depicts a cross-sectional view, taken along a portion of line 6-6 of FIG. 5, of the exemplary first end of the cartridge of the interruption sub of FIG. 2, with the barrier in the open position.
Figure 7:
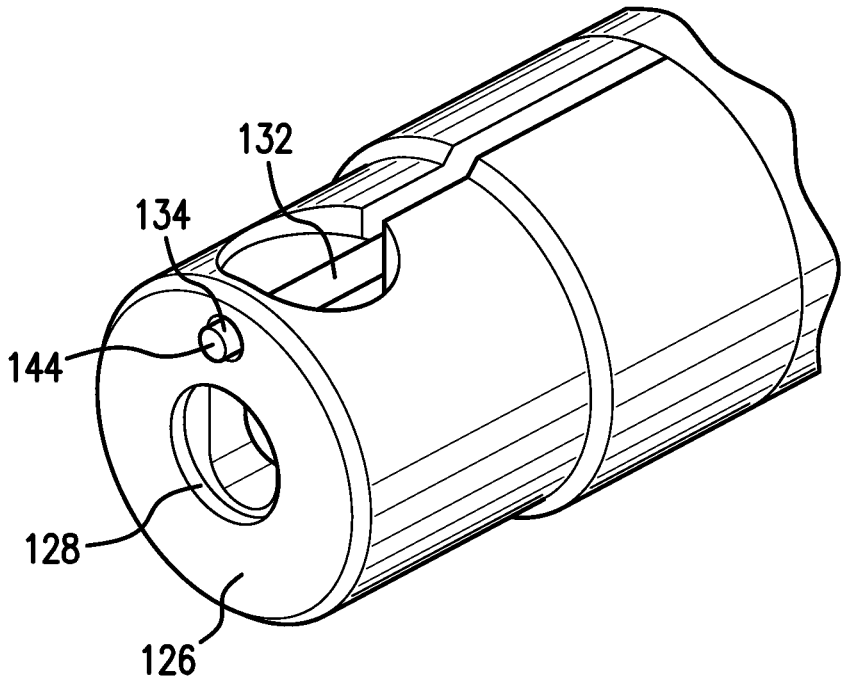
FIG. 7 depicts a perspective view of the first end of the cartridge for the interruption sub of FIG. 2 with the barrier in the open position.
Figure 8:
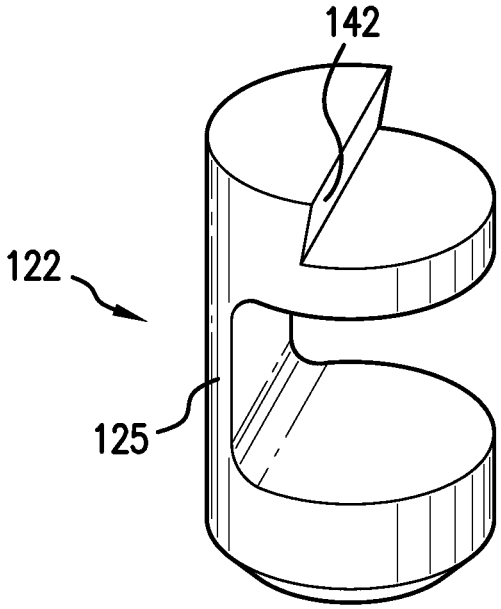
FIG. 8 depicts a perspective view of an exemplary embodiment of the barrier.

Disposed within the inner longitudinal bore 74 of the cartridge 36 is a booster 118 at the first end 76 of the cartridge 36. The booster 118 is crimped to a detonation cord 120 that passes through the inner longitudinal bore 74 of the cartridge 36 and into the second fitting 44 of the first housing 34 for connection with the perforation gun 26. The booster 118 may be nested within a rotatable barrier 122, an exemplary embodiment of which is shown in FIG. 8. The rotatable barrier 122 is located at the first end 76 of the cartridge 36, within the first outer portion 78, and is biased to a closed position by a second spring 124, such as a torsion spring. The closed position of the barrier 122 is shown in FIGS. 2-4. In the closed position, a blocking portion 125 of the barrier 122 prevents access into the inner longitudinal bore 74 from the first end 76 of the cartridge 36. The first end 76 of the cartridge 36 includes a first end wall 126 with a first opening 128 to the inner longitudinal bore 74 which is blocked by the blocking portion 125 in the closed position of the barrier 122. The barrier 122 remains in the biased closed position when the first spring 96 is uncompressed (or only partially compressed) as illustrated in FIG. 2. The longitudinally movable control arm 102 is biased in the inactivated position shown in FIGS. 2-4 by the ring portion 100 of the control arm 102 being biased in direction B by the first spring 96. Adjacent the second end 86 of the cartridge 36, a retaining ring 130 threads into the longitudinal bore 52 of the first housing 34 to retain the cartridge 36 within the first housing 34.

When ambient pressure surrounding the first housing 34 of the interruption sub 32 is less than a set amount or outside of a certain range, such as when the ambient pressure is at normal surface pressure or pressure existing at shallow downhole depths, then the ambient pressure entering the longitudinal bore 52 of the first housing 34 through the lateral aperture 54 is insufficient to move the follower sleeve 108 in direction A against the bias of the first spring 96. In such an inactivated condition, the indicator marking 110 of the follower sleeve 108 is visible through the lateral aperture 54, providing an operator at surface an indication that the barrier 122 is in the closed position. When the ambient pressure surrounding the interruption sub 32 is more than a set amount or within a certain range, such as when the ambient pressure is at pressures encountered at bore depths where perforating gun 26 or other attached downhole tool is employable, the pressure entering the lateral aperture 54 and grooved ring 58 pushes the follower sleeve 108 in direction A, against the bias of the first spring 96. That is, when the ambient pressure is indicative of a minimum borehole depth acceptable for downhole tool activation, the control arm 102 is activated hydraulically by the ambient hydraulic pressure. Movement of the follower sleeve 108 in direction A, enabled by the spacing between rings of the first ring 96, pushes the spacers 104 and seals 106 in the direction A against the ring portion 100 of the control arm 102, which in turn moves the ring portion 100 of the control arm 102 against the first spring 96, compressing the first spring 96. The first end 114 of the compression spring 112 likewise moves in direction A, urging the follower sleeve 108 in direction A and moving the indicator marking 110 out of view through the lateral aperture 54.

As the ring portion 100 of the control arm 102 moves in direction A, so does an arm portion 132 of the control arm 102. The arm portion 132 includes a first end 134 resting against the barrier 122 and a second end 136, also a second end 136 of the control arm 102 as shown, attached to the ring portion 100. The arm portion 132 of the control arm 102 longitudinally extends from the ring portion 100 of the control arm 102 towards the barrier 122, and is longitudinally movable within a slot 138 extending through the first, second, and part of the third outer portions 78, 80, 82 of the second housing 70. In the inactivated state, the arm portion 132 rests against the barrier 122 and the barrier 122 remains in the biased closed position by the second spring 124. A stop surface of the barrier 122 may rest against the arm portion 132 to prevent the barrier 122 from over-rotating. In the activated state, the first end 134 of the arm portion 132 is pushed in the direction A against a cam surface 142 (FIG. 4) of the barrier 122, rotating the barrier 122 against the bias of the second spring 124 until the first end 134 of the arm portion 132 is guided through a control arm opening 144 (FIG. 7) in the first end wall 126 of the second housing 70. Also in the activated state, the blocking portion 125 of the barrier 122 is rotated away from the first opening 128 in the first end wall 126 of the second housing 70 providing communication between the firing head apparatus 24 and the booster 118. When the ambient pressure decreases below a set value, such as when the interruption sub 32 and its attached components are pulled from the borehole, the follower sleeve 108 moves in direction B, the first spring 96 decompresses, pushing the ring portion 100 of the control arm 102 towards direction B, which in turn moves arm portion 132 in direction B away from the barrier 122. The second spring 124 is allowed to return to its biased condition to rotate the barrier 122 such that blocking portion 125 blocks the first opening 128 again, thus preventing inadvertent activation of the booster 118, if it has not already been activated. Thus, the interruption sub 32 of FIGS. 2-8 provides a barrier 122 activatable in response to pressure. While details of an exemplary embodiment for activation of the barrier 122 from a biased closed position to an open position have been provided, it should be understood that alternate arrangements for employing ambient hydraulic pressure to activate the barrier 122 may also be employed.

Figure 9:
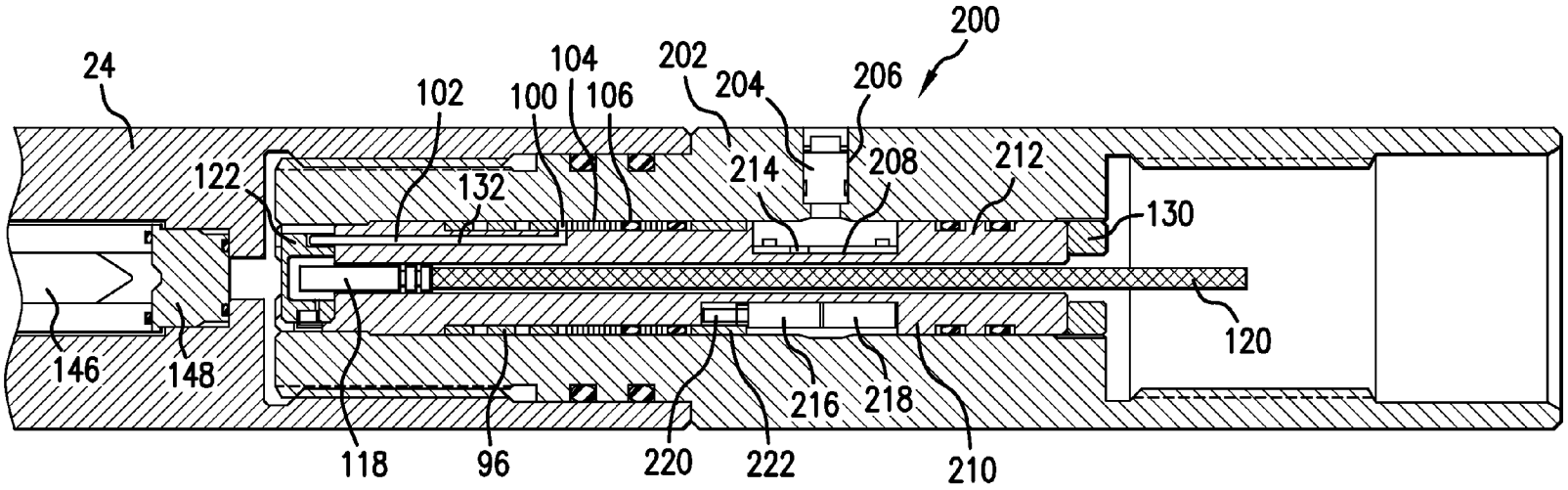
FIG. 9 depicts a sectional view, taken along a portion of line 1-1 of FIG. 1, of another exemplary embodiment of an interruption sub of FIG. 1 with a barrier in the closed position; and, FIG. 10 depicts a sectional view, taken along a portion of line 1-1 of FIG. 1, of the interruption sub of FIG. 9, with the barrier in the open position.
Figure 10:
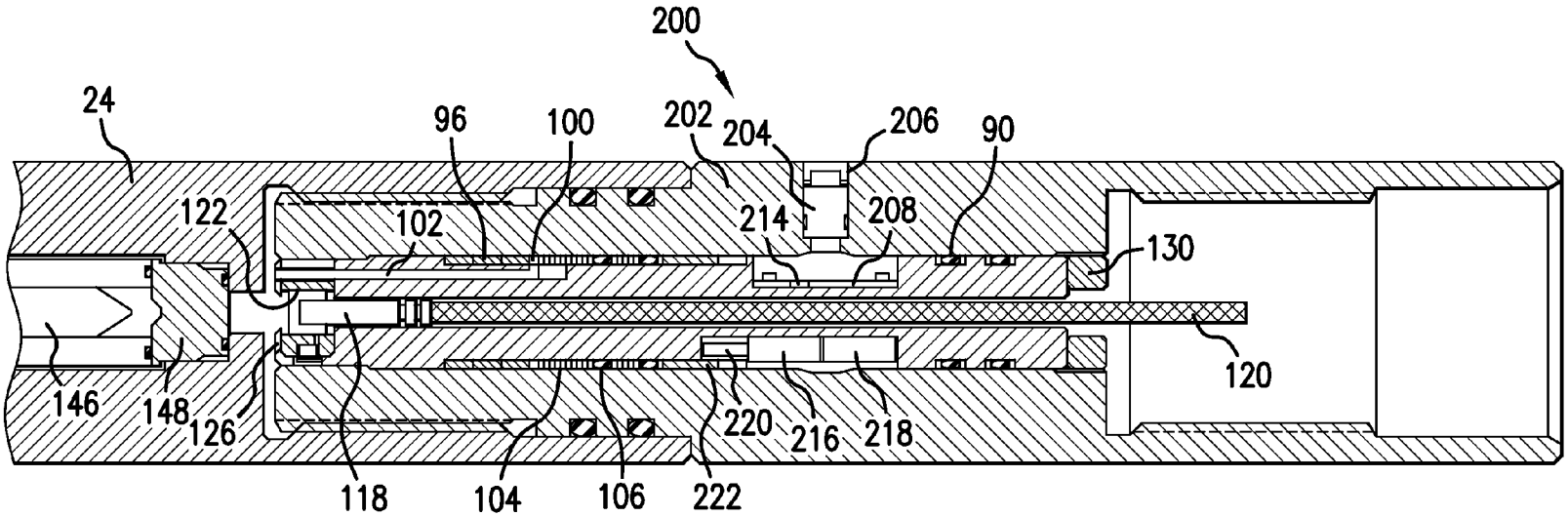

Turning now to FIGS. 9-10, another exemplary embodiment of an interruption sub 200 is similar to the interruption sub 32 of FIGS. 2-8, except that the actuating force to move the control arm 102 is provided mechanically instead of hydraulically. The first housing 202 of the interruption sub 200 is similar to the first housing 34 of the interruption sub 32, except that a pressure sensor 204 is positioned within a lateral aperture 206 of the first housing 202. The pressure sensor 204 is exposed to the pressure of fluid outside of the interruption sub 200. The pressure sensor 204 communicates with, such as via an electrical connection, an electronic control board 208 secured to the second housing 210 of the cartridge 212. The electronic control board 208 may further include a temperature sensor 214, although the temperature sensor 214 may be located elsewhere within the interruption sub 200 and in communication with the electronic control board 208. A mechanical actuator 216 is also provided in the second housing 210, and responsive to the outputs of the pressure sensor 204 and/or the temperature sensor 214. The mechanical actuator 216 may be powered by battery 218, and may include a solenoid switch or other electro-mechanical motion. When information regarding a condition or set of conditions, such as a certain pressure limit and/or temperature, is processed by the electronic control board 208, the mechanical actuator 216 is actuated to move an actuation ring 222, which surrounds the second housing 210, along an actuating arm 220 in direction A, pushing the seal 106 and spacers 104, and the ring portion 100 and arm portion 132 of the control arm 102 in direction A against the bias of the first spring 96 to move the barrier 122 from the closed condition to the open condition. That is, when the ambient pressure and/or the ambient temperature is indicative of a minimum borehole depth for downhole tool activation, the control arm 102 is activated electronically. While details of an exemplary embodiment for activation of the barrier 122 from a biased closed position to an open position have been provided, it should be understood that alternate arrangements for employing electromechanical activation of the barrier 122 may also be employed. Because this embodiment employs an electronic control board 208 providing an electronic control signal to the mechanical actuator 216, a number of programmable conditions and actuation features may be utilized to customize the opening and closing of the barrier 122, such as, but not limited to, time delays, acceleration sensors, and safety ranges, in addition to pressure and/or temperature conditions.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An interruption sub for a downhole tool, the downhole tool activatable by detonation, the interruption sub comprising:

a detonation path within the interruption sub;

a barrier rotatable between a biased closed position and an open position, and preventing ballistic transfer to the downhole tool in the closed position by blocking the detonation path, and allowing ballistic transfer to the downhole tool in the open position by unblocking the detonation path; and, a longitudinally movable control arm engageable with the barrier, the control arm biased away from a first end of the interruption sub to retain the barrier in the biased closed position;

wherein the control arm is hydraulically or electromechanically longitudinally activatable to move towards the first end of the interruption sub and towards the barrier to rotate the barrier against its bias to the open position in response to at least one condition acceptable for ballistic transfer.

2. The interruption sub of claim 1, wherein the at least one condition is at least one of an ambient temperature and an ambient pressure indicative of a minimum borehole depth for activation of the downhole tool.

3. The interruption sub of claim 2, wherein ambient pressure, at the minimum borehole depth for activation of the downhole tool, hydraulically activates the barrier to the open position.

4. The interruption sub of claim 2, wherein the barrier is electromechanically activated to the open position in response to an ambient temperature signal at the minimum borehole depth for activation of the downhole tool.

5. The interruption sub of claim 2, wherein the barrier is electromechanically activated to the open position in response to an ambient pressure signal at the minimum borehole depth for activation of the downhole tool.

6. The interruption sub of claim 1, further comprising a booster nested within the barrier and a detonation cord in the detonation path.

7. The interruption sub of claim 1, wherein the barrier is located at the first end of the interruption sub, the first end including a control arm opening configured to receive the control arm therein upon longitudinal movement of the control arm past the barrier in the open position.

8. The interruption sub of claim 1, wherein the control arm is hydraulically activatable using ambient pressure.

9. The interruption sub of claim 1, wherein the control arm is electromechanically activatable in response to at least one of an ambient temperature signal and an ambient pressure signal.

10. The interruption sub of claim 1, further comprising a first spring biasing the control arm away from the barrier and a second spring biasing the barrier to the closed position.

11. The interruption sub of claim 1, further comprising a spring located between a second end of the control arm and the barrier.

12. The interruption sub of claim 11, further comprising a follower device moving the second end of the control arm and compressing the spring when the at least one condition is met.

13. The interruption sub of claim 12, wherein the follower device includes a marking visible through a lateral aperture in a housing of the interruption sub when the follower device is in a position corresponding to one of the open and closed positions of the barrier, and the marking is moved out of visibility through the lateral aperture when the follower device is in a position corresponding to another of the open and closed positions of the barrier.

14. The interruption sub of claim 11, further comprising a mechanical actuator moving the second end of the control arm against bias of the spring when the at least one condition is met.

15. The interruption sub of claim 14, wherein the mechanical actuator is directed by an electronic control signal.

16. The interruption sub of claim 1, further comprising a first housing having a longitudinal bore and a cartridge having a second housing, the cartridge positioned within the longitudinal bore, the cartridge including the barrier and detonation path.

17. The interruption sub of claim 16, wherein a first fitting of the first housing is engageable with a housing of a ballistic initiator, and a second fitting of the first housing is engageable with the downhole tool.

18. The interruption sub of claim 1, further comprising an electronic control board activating a mechanical actuator in response to the at least one condition to move the barrier.

19. The interruption sub of claim 18, further comprising a pressure sensor within a lateral aperture of a housing of the interruption sub, wherein the pressure sensor is in communication with the electronic control board.

20. The interruption sub of claim 18, further comprising a temperature sensor in communication with the electronic control board.

21. A downhole tool activatable by detonation, the downhole tool comprising:

an explosive member;

a detonation member; and, an interruption sub disposed between the explosive member and the detonation member, the interruption sub including:

a detonation path within the interruption sub;

a barrier rotatable between a biased closed position and an open position, and preventing ballistic transfer to the detonation member in the closed position by blocking the detonation path, and allowing ballistic transfer to the detonation member in the open position by unblocking the detonation path; and, a longitudinally movable control arm engageable with the barrier, the control arm biased away from a first end of the interruption sub to retain the barrier in the biased closed position;

wherein the control arm is hydraulically or electromechanically longitudinally activatable to move towards the first end of the interruption sub and towards the barrier to rotate the barrier against its bias to the open position in response to at least one condition acceptable for ballistic transfer.

22. The downhole tool of claim 21, wherein the explosive member is a perforating gun.

* * * * *